US009291381B2

(12) United States Patent
Nelson

(10) Patent No.: US 9,291,381 B2
(45) Date of Patent: Mar. 22, 2016

(54) CLEAR ICE MAKING MACHINE

(71) Applicant: William G. Nelson, South Haven, MN (US)

(72) Inventor: William G. Nelson, South Haven, MN (US)

( * ) Notice: Subject to any disclaimer, the term of this patent is extended or adjusted under 35 U.S.C. 154(b) by 228 days.

(21) Appl. No.: 13/675,476

(22) Filed: Nov. 13, 2012

(65) Prior Publication Data

US 2013/0145777 A1 Jun. 13, 2013

(51) Int. Cl.

| | |
|---|---|
| ***F25C 1/24*** | (2006.01) |
| ***F25C 1/00*** | (2006.01) |
| ***F25C 1/18*** | (2006.01) |
| ***F25C 5/00*** | (2006.01) |

(52) U.S. Cl.

CPC ... *F25C 1/00* (2013.01); *F25C 1/18* (2013.01); *F25C 1/24* (2013.01); *F25C 5/005* (2013.01); *Y10T 29/4935* (2015.01)

(58) Field of Classification Search

CPC ..... F25C 1/24; F25C 2500/02

USPC ..... 62/66, 340; 165/104.26; 248/220.21, 248/220.22, 223.41, 224.51, 224.61; 403/381

See application file for complete search history.

(56) References Cited

U.S. PATENT DOCUMENTS

| | | | | |
|---|---|---|---|---|
| 3,775,992 | A | 12/1973 | Bright | |
| 3,788,089 | A * | 1/1974 | Graves | 62/137 |
| 3,962,886 | A * | 6/1976 | Hammar | 62/340 |
| 4,003,214 | A * | 1/1977 | Schumacher | 62/340 |
| 5,187,948 | A | 2/1993 | Frohbieter | |
| 6,176,641 | B1 * | 1/2001 | Schenk | 403/381 |
| 7,201,014 | B2 | 4/2007 | Hornung | |
| 2004/0025527 | A1 | 2/2004 | Takahashi et al. | |
| 2007/0227162 | A1 | 10/2007 | Wang | |
| 2010/0251744 | A1 * | 10/2010 | Yun et al. | 62/340 |
| 2011/0209483 | A1 | 9/2011 | Hall et al. | |
| 2012/0090346 | A1 * | 4/2012 | Mitchell et al. | 62/340 |
| 2012/0324915 | A1 * | 12/2012 | Bortoletto et al. | 62/66 |
| 2012/0324917 | A1 * | 12/2012 | Bortoletto et al. | 62/71 |
| 2014/0165602 | A1 * | 6/2014 | Boarman | 62/3.3 |

* cited by examiner

*Primary Examiner* — Mohammad M Ali
*Assistant Examiner* — Christopher R Zerphey
(74) *Attorney, Agent, or Firm* — Kinney & Lange, P.A.

(57) ABSTRACT

An ice making machine includes a heat pipe that extends between a freezer compartment and a refrigerator compartment. The heat pipe has a first end in the freezer compartment and a second end in the refrigerator compartment. A heat exchanger is located in the freezer compartment and is in contact with the first end of the heat pipe. A heat block is located in the refrigerator compartment and is in contact with the second end of the heat pipe. A removable ice cube tray is mounted on the heat block with a surface in contact with the heat block such that when the removable ice cube tray is filled with water, ice forms from the surface of the removable ice cube tray in contact with the block.

12 Claims, 4 Drawing Sheets

CLEAR ICE MAKING MACHINE

BACKGROUND

The present invention is related to ice making, and more specifically a clear ice making machine and methods of using and assembling the clear ice making machine.

Traditionally, making ice cubes at home includes filling the molds in an ice cube tray with water and placing the ice cube tray in a freezer compartment of a refrigerator. The temperature of the freezer compartment is typically much lower than 32 degrees Fahrenheit. The temperature in the freezer compartment causes the water in the molds to freeze. Initial freezing occurs at the outer surfaces. As a result, air and other gases are trapped in the ice, resulting in cloudy ice cubes. Any impurities in the water are also trapped in the ice, adding to the cloudiness of the ice cubes.

Currently, there are clear ice making systems that allow water to come in contact with a cold surface. The cold surface is either the evaporator part of a refrigeration system or a surface in thermal contact with the evaporator. Ice forms on the cold surface and grows in a direction relatively perpendicular to the surface. This method does not trap air and other gases and thus results in clear ice formation. However, a heat source is necessary to warm the cold surface in order to harvest the ice.

SUMMARY

In one embodiment, a clear ice making machine includes a heat pipe that extends between a freezer compartment and a refrigerator compartment. The heat pipe has a first end in the freezer compartment and a second end in the refrigerator compartment. A heat exchanger is located in the freezer compartment and is in contact with the first end of the heat pipe. A heat block is located in the refrigerator compartment and is in contact with the second end of the heat pipe. A removable ice cube tray is mounted on the heat block with a surface in contact with the heat block such that when the removable ice cube tray is filled with water, ice forms from the surface of the removable ice cube tray in contact with the block.

In another embodiment, a method of making clear ice includes filling an ice cube tray with water. Heat is exchanged between a heat exchanger and a first end of a heat pipe located in a freezer compartment. Heat is exchanged between a heat block and a second end of the heat pipe located in a refrigerator compartment. An ice cube tray is mounted on the heat block so that when the ice cube tray is filled with water, ice forms from the surface of the ice cube tray in contact with the heat block.

In another embodiment, a method of assembling a clear ice making machine includes mounting a heat pipe in a refrigerator so that a first end of the heat pipe is in a freezer compartment and a second end of the heat pipe is in a refrigerator compartment. A heat exchanger is mounted on the first end of the heat pipe in the freezer compartment. A heat block is mounted on the second end of the heat pipe in the refrigerator compartment. An ice cube tray is mounted on the heat block. The ice cube tray and the heat block are configured so that when the ice cube tray is filled with water, ice forms from the surface of the ice cube tray in contact with the heat block.

DETAILED DESCRIPTION

The present invention provides a clear ice making machine, a method of using the clear ice making machine, and a method of assembling the clear ice making machine. In particular, the present invention grows ice cubes in an ice cube tray from the surface of the ice cube tray in contact with a block containing at least one heat pipe, allowing air to be pushed out from the ice in the tray as the ice forms, resulting in clear ice. The present invention allows clear ice to be made in a conventional refrigerator and is independent from the refrigeration system of a conventional refrigerator. The present invention can be made with no moving parts, or it can be fully automated. The present invention can be installed in an existing refrigerator with a freezer compartment. Alternatively, a refrigerator can be manufactured to include the present invention.

Figure 1:
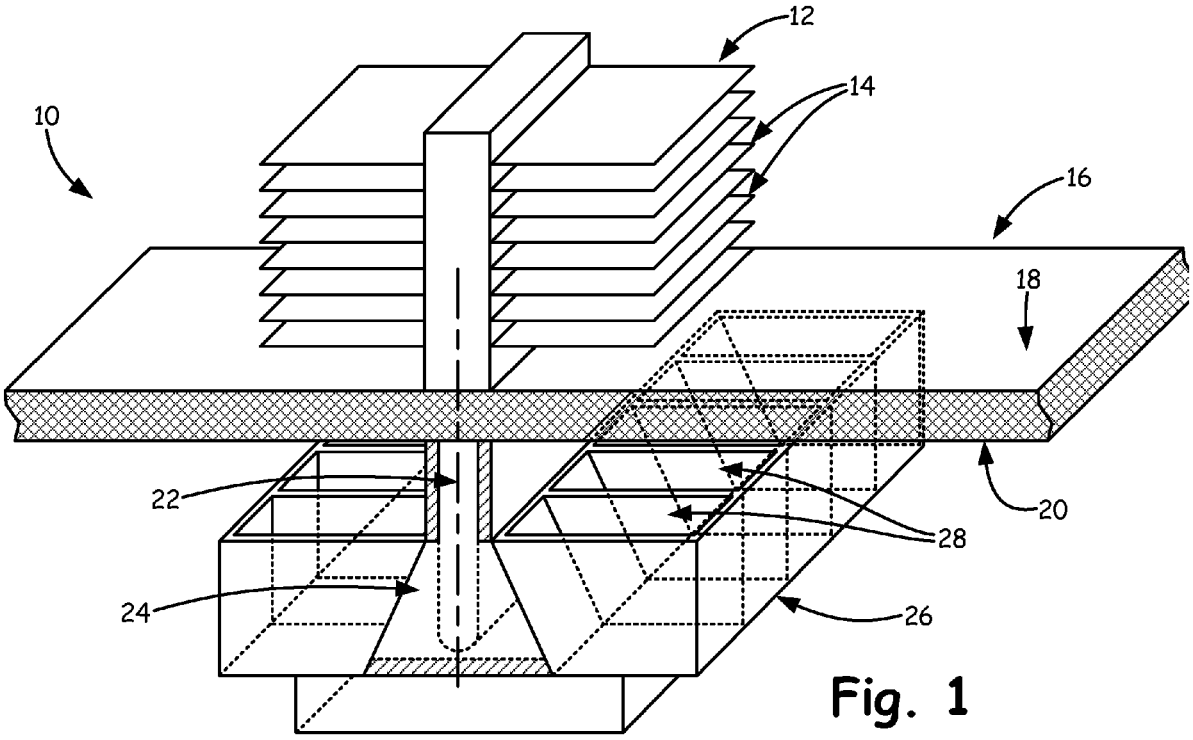
FIG. 1 is a perspective view of the clear ice making machine.

FIG. 1 is a perspective view of clear ice making machine 10. Clear ice making machine 10 includes heat exchanger 12 with heat exchanger fins 14, freezer insulation 16 with freezer compartment side 18 and refrigerator compartment side 20, heat pipe 22, heat block 24, and ice cube tray 26 with ice cube molds 28.

Figure 2:
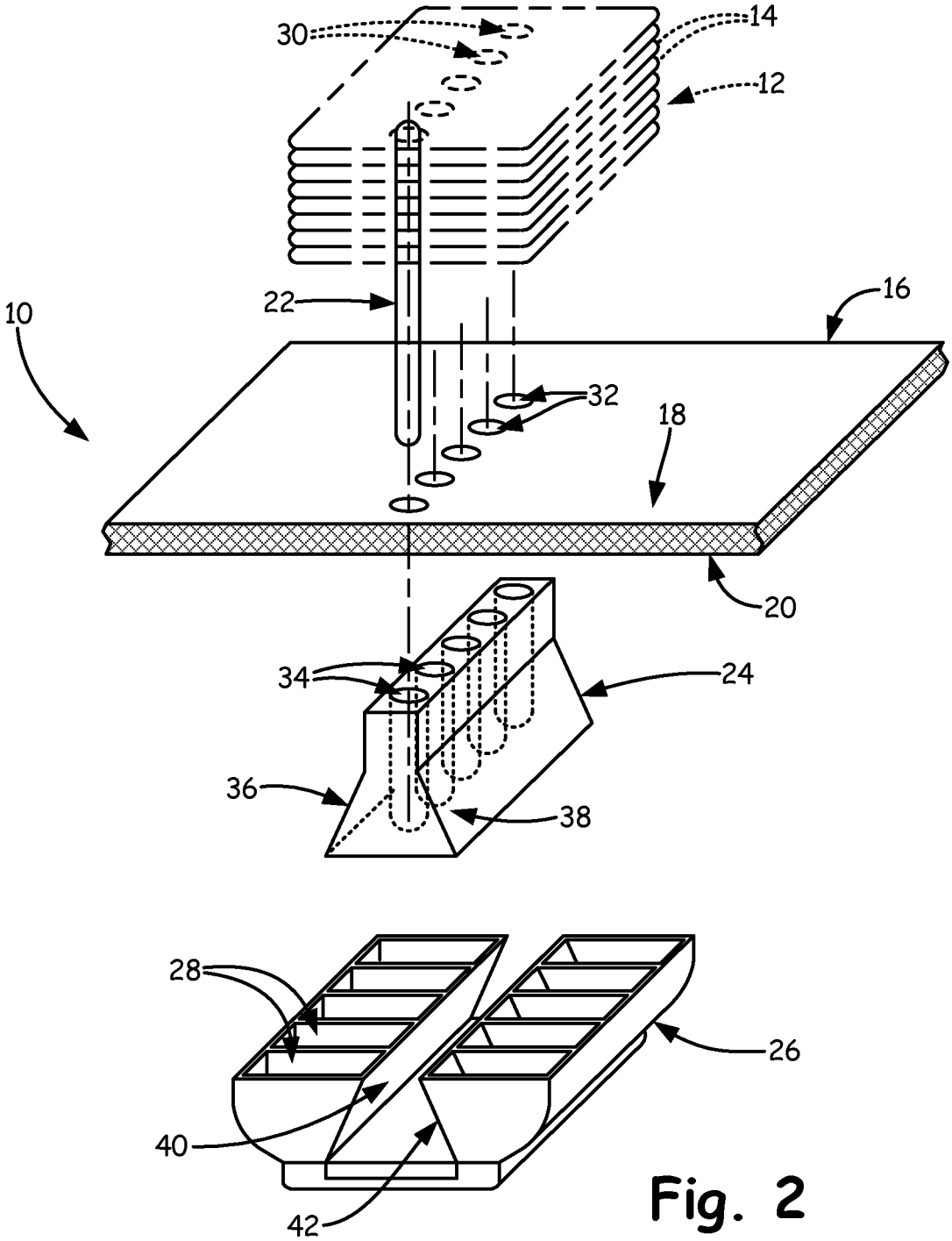
FIG. 2 is an exploded view of the clear ice making machine.

FIG. 2 is an exploded view of clear ice making machine 10. Heat exchanger 12 of clear ice making machine 10 further includes heat exchanger bores 30. Freezer insulation 16 further includes freezer insulation bores 32. Heat block 24 further includes heat block bores 34 and tray contact sides 36 and 38. Ice cube tray 26 further includes heat block contact sides 40 and 42.

Heat exchanger 12 of clear ice making machine 10 is located in the freezer compartment of a refrigerator, on freezer compartment side 18 of freezer insulation 16. Heat block 24 is located in the refrigerator compartment of a refrigerator, on refrigerator compartment side 20 of freezer insulation 16. Heat pipe 22 passes through one of freezer insulation bores 32 in freezer insulation 16, with one end on freezer compartment side 18 and another on refrigerator compartment side 20 of freezer insulation 16. Heat pipe 22 fits into one of heat exchanger bores 30 such that heat pipe 22 is in contact with heat exchanger 12. Heat pipe 22 also fits into one of heat block bores 34 such that heat pipe 22 is in contact with heat block 24.

Ice is formed in ice cube tray 26 of clear ice making machine 10. Ice cube tray 26 is removable from clear ice making machine 10, which allows ice harvest without a source of heat to detach the ice from the cooling device. Ice cube tray 26 can be made of plastic molded parts or parts made of a thermally conductive material. In alternative embodiments, ice cube tray can be made of injection molded parts, vacuum molded parts, rotomolded parts, or any other suitable alternative. Ice cube tray 26 is filled with water and subsequently mounted to heat block 24. When ice cube tray 26 is mounted on heat block 24, heat block contact sides 40 and 42 of ice cube tray 26 and tray contact sides 36 and 38 of heat block 24 are in thermal contact.

Heat exchanger 12 cools heat pipe 22. Heat exchanger 12 may be made of copper, aluminum, stainless steel, or any other suitable material with a thermal conductivity of at least 0.01 cal/s*cm*C.°. In one embodiment, heat exchanger 12 includes heat exchanger fins 14. In another embodiment, heat exchanger 12 may contain a pool of eutectic material such as a glycol mixture, which allows for a higher rate of heat transfer between heat exchanger 12 and heat pipe 22.

Heat pipe 22 may be made of any suitable material with a thermal conductivity of at least 0.01 cal/s*cm*C.° and contains a refrigerant, which can be a high pressure refrigerant such as 134a refrigerant. Heat pipe 22 cools heat block 24 such that heat is transferred between tray contact sides 36 and 38 of heat block 24 and heat block contact sides 40 and 42 of ice cube tray 26. Tray contact sides 36 and 38 of heat block 24 may be dovetail shaped, optimizing thermal contact with heat block contact sides 40 and 42 of ice cube tray 26. A dovetail shape also allows ice cube tray 26 to be easily mounted onto heat block 24. Heat block 24 may be made of copper, aluminum, stainless steel, or any other suitable material with a thermal conductivity of at least 0.01 cal/s*cm*C.°. Heat block 24 may also be insulated on non-contact surfaces to reduce heat transfer to those surfaces, increasing overall heat transfer efficiency of clear ice making machine 10.

When heat is transferred between heat block 24 and ice cube tray 26, ice begins to form laterally in ice cube molds 28 from heat block contact sides 40 and 42 of ice cube tray 26. This occurs because significant heat transfer only occurs at heat block contact sides 40 and 42 of ice cube tray 26. In a traditional ice cube tray in a freezer section of a refrigerator, water in the molds of an ice cube tray starts to freeze at the outer surfaces of each mold, trapping any air and impurities in the water within, resulting in cloudy ice cubes. Lateral ice formation in ice cube tray 26 allows air to escape during ice formation, preventing cloudiness due to trapped air. Additionally, lateral ice formation in ice cube tray 26 allows impurities to escape. As a result, only the last of the water to freeze in molds 28 of ice cube tray 26 contains impurities, thus only a small piece of each ice cube may be cloudy and impure.

Figure 3:
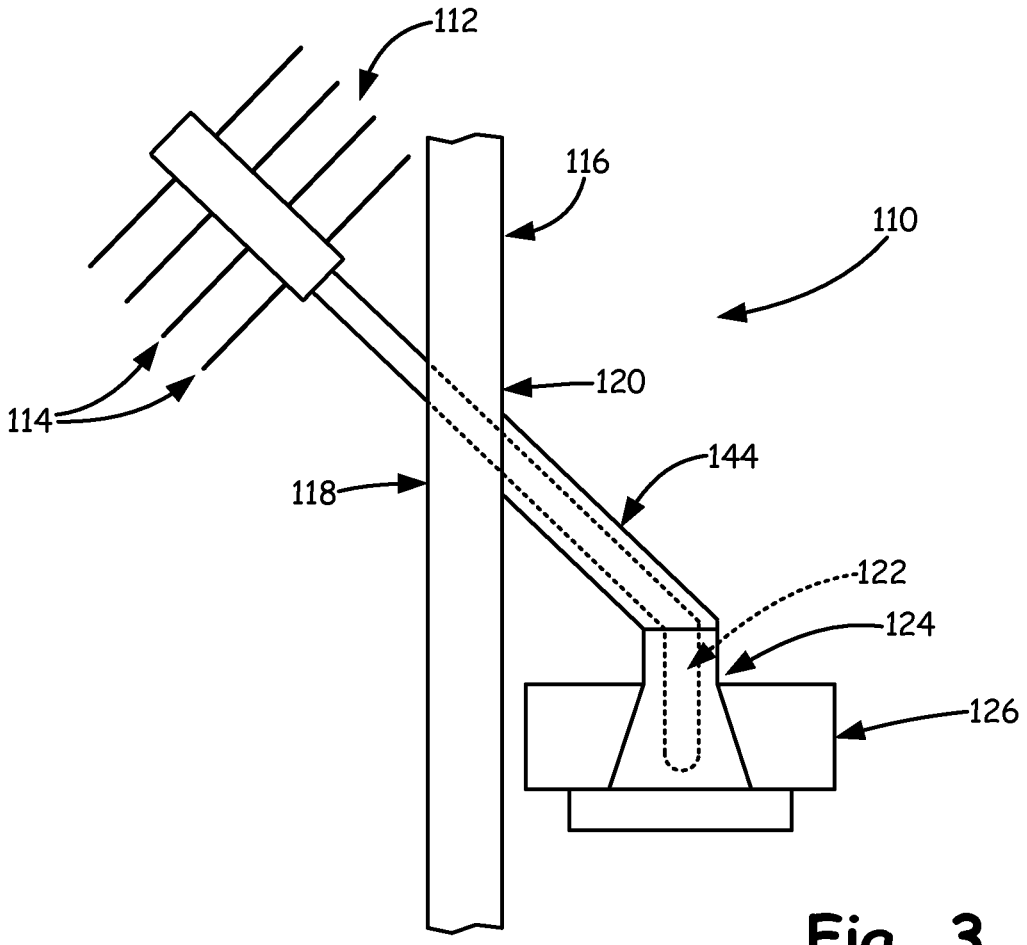
FIG. 3 is an alternate perspective view of the clear ice making machine in a side-by-side refrigerator.

FIG. 3 is a perspective view of clear ice making machine 110 in a side-by-side refrigerator. Clear ice making machine 110 includes heat exchanger 112 with heat exchanger fins 114, freezer insulation 116 with freezer compartment side 118 and refrigerator compartment side 120, heat pipe 122, heat block, 124, ice cube tray 126, and heat pipe insulation 144. Heat pipe 122 passes through freezer insulation 116, and insulation 144 prevents heat pipe 122 from losing thermal efficiency in a refrigerator compartment.

Figure 4:
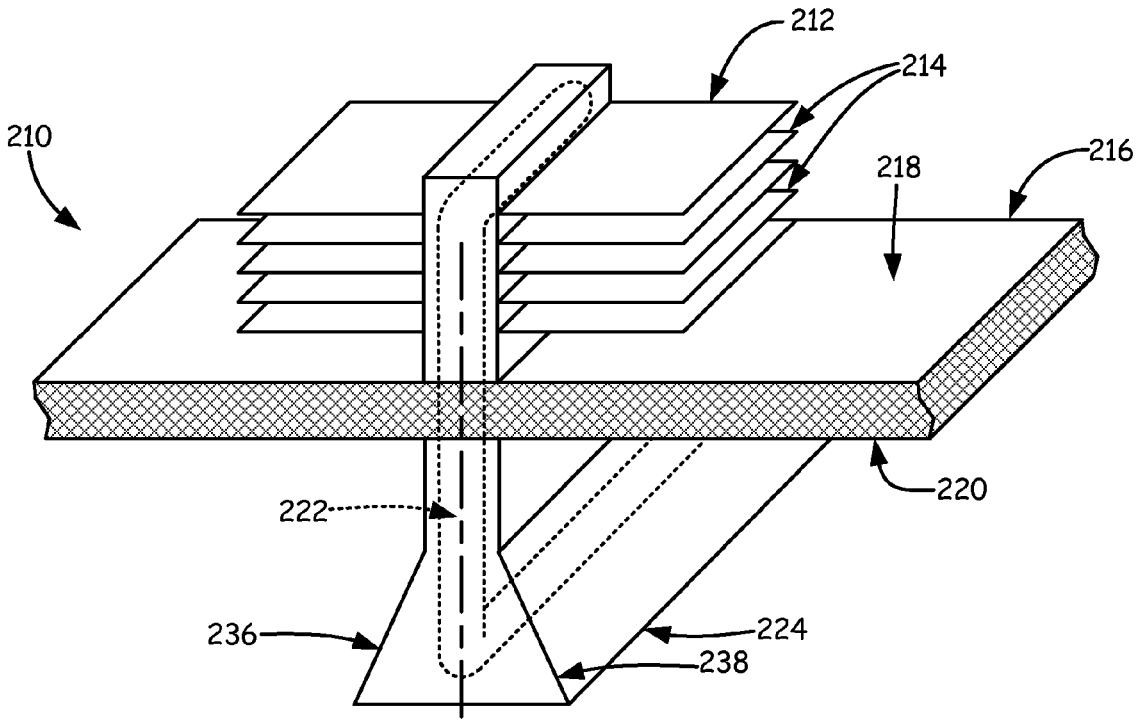
FIG. 4 is a perspective view of the clear ice making machine with a single heat pipe.
Figure 4:
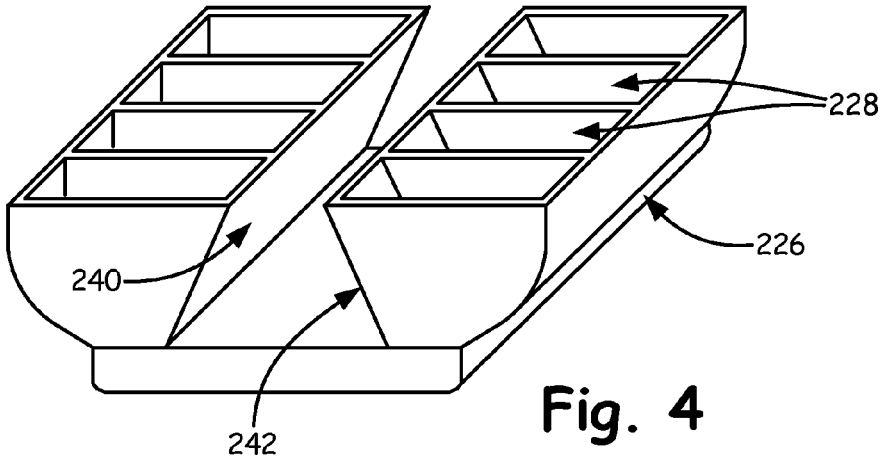

FIG. 4 is a perspective view of clear ice making machine 210. Clear ice making machine 210 includes heat exchanger 212 with heat exchanger fins 214, freezer insulation 216 with freezer compartment side 218 and refrigerator side 220, heat pipe 222, heat block 224, and ice cube tray 226 with ice cube molds 228. Heat block 224 further includes tray contact sides 236 and 238. Ice cube tray 226 further includes heat block contact sides 240 and 242.

Clear ice making machine 210 requires only one heat pipe 222. Heat pipe 222 passes through a single bore in freezer insulation 216, minimizing need for modification of freezer insulation 216 in a refrigerator. One end of heat pipe 222 extends along the length of heat exchanger 212 and the other end of heat pipe 222 extends along the length of heat block 224. This allows for heat transfer to efficiently occur between tray contact sides 236 and 238 of heat block 224 and heat block contact sides 240 and 242 of ice cube tray 226. Ice forms laterally in ice cube molds 228 from heat block contact sides 240 and 242 of ice cube tray 226, resulting in formation of clear ice cubes in each of molds 228.

Figure 5:
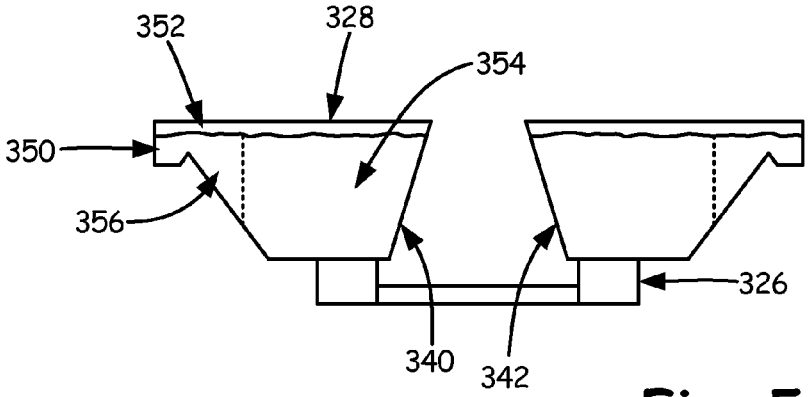
FIG. 5 is a cross sectional view of one embodiment of the ice cube tray of the clear ice making machine.

FIG. 5 is a cross sectional view of one embodiment of ice cube tray 326. Ice cube tray 326 includes ice cube molds 328 and heat block contact sides 340 and 342. Ice cube tray 326 also includes cavity 350, water level 352, ice 354, and water 356. Ice 354 in ice cube molds 328 is formed laterally from heat block contact sides 340 and 342 of ice cube tray 326.

Lateral formation of ice 354 in ice cube tray 326 allows air to escape during ice formation, preventing cloudiness due to trapped air. Additionally, lateral formation of ice 354 in ice cube tray 326 allows impurities to escape. As a result, only the last of water 356 to freeze in molds 328 of ice cube tray 326 contains impurities. The last of water 356 to freeze in molds 328 of ice cube tray 326 freezes in cavity 350, forming an ice chip containing any impurities of water 356. Therefore, when an ice cube is removed from molds 328, the impure and cloudy ice chip formed in cavity 350 can be easily broken off or melted from ice 354, resulting in a completely clear and pure ice cube.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An ice making machine comprising:

a heat pipe that extends between a freezer compartment and a refrigerator compartment and has a first end in the freezer compartment and a second end in the refrigerator compartment;

a heat exchanger located in the freezer compartment and in contact with the first end of the heat pipe;

a heat block located in the refrigerator compartment and in contact with the second end of the heat pipe, the heat block having a lower portion with a wider cross section than an upper portion; and a removable ice cube tray located in the refrigerator compartment and configured to be mounted on the heat block, the ice cube tray comprising:

a first inner side wall and a second inner side wall that define an opening with an upper portion having a cross section that is narrower than the cross section of the lower portion of the heat block; and a first outer side wall and a second outer side wall spaced laterally away from the first inner side wall and the second inner side wall, respectively;

wherein the heat block and the opening of the removable ice cube tray are complimentary shapes such that the removable ice cube tray is configured to slide onto the heat block such that the lower portion of the heat block is positioned within the opening of the ice cube tray and the ice cube tray is supported by the heat block; and wherein a first tray contact side of the heat block is configured to be in contact with the first inner side wall of the ice cube tray and a second tray contact side of the heat block is configured to be in contact with the second inner side wall of the ice cube tray when the ice cube tray is mounted on the heat block such that when the ice cube tray is filled with water, clear, pure ice forms laterally away from the first inner side wall toward the first outer side wall of the ice cube tray and forms laterally away from the second inner side wall toward the second outer side wall of the ice cube tray.

2. The ice making machine of claim 1, wherein the heat pipe contains a refrigerant.

3. The ice making machine of claim 1, wherein the heat block comprises a solid material with a thermal conductivity of at least 0.01 cal/s*cm*C.°.

4. The ice making machine of claim 1, wherein the heat block is insulated everywhere except for the first tray contact side of the heat block that is in contact with the first inner side wall of the ice cube tray and the second tray contact side of the heat block that is in contact with the second inner side wall of the ice cube tray.

5. The ice making machine of claim 1, wherein the heat exchanger comprises fins comprised of a solid material with a thermal conductivity of at least 0.01 cal/s*cm*C.°.

6. The ice making machine of claim 1, wherein the ice cube tray is configured such that water that freezes last forms a piece of ice containing undesirable impurities in a cavity of the ice cube tray such that the piece can be broken off or melted from the clear, pure ice formed in the ice cube tray.

7. An ice making machine comprising:

a heat pipe that extends between a freezer compartment and a refrigerator compartment and has a first end in the freezer compartment and a second end in the refrigerator compartment;

a heat exchanger located in the freezer compartment and in contact with the first end of the heat pipe;

a heat block located in the refrigerator compartment and in contact with the second end of the heat pipe, the heat block having a first tray contact side, a second tray contact side, and a lower portion with a wider cross section than an upper portion; and a removable ice cube tray located in the refrigerator compartment and configured to be mounted on the heat block, the ice cube tray comprising:

an opening with an upper portion having a cross section that is narrower than the cross section of the lower portion of the heat block;

a first tray section with a first plurality of cavities, a first outer side wall, and a first inner side wall that extends along the first plurality of cavities and forms one side of each of the first plurality of cavities; and a second tray section with a second plurality of cavities, a second outer side wall, and a second inner side wall that extends along the second plurality of cavities and forms one side of each of the second plurality of cavities;

wherein the heat block and the removable ice cube tray are complimentary shapes such that the removable ice cube tray is configured to slide onto the heat block such that the lower portion of the heat block is positioned within the opening of the ice cube tray and the ice cube tray is supported by the heat block, and such that the first inner side wall of the first tray section is in contact with the first tray contact side of the heat block and the second inner side wall of the second tray section is in contact with the second tray contact side of the heat block, and the first outer side wall and the second outer side wall are spaced from the heat block;

wherein an opening of each of the first plurality of cavities of the ice cube tray is wider than a bottom surface of each of the first plurality of cavities so that when the ice cube tray is filled with water, clear, pure ice forms in each of the first plurality of cavities laterally away from the first side wall and a portion of water that is last to freeze is adjacent the first outer side wall and furthest from the bottom surface of each of the first plurality of cavities; and wherein an opening of each of the second plurality of cavities of the ice cube tray is wider than a bottom surface of each of the second plurality of cavities so that when the ice cube tray is filled with water, clear, pure ice forms in each of the second plurality of cavities laterally away from the second side wall and a portion of water that is last to freeze is adjacent the second outer side wall and furthest from the bottom surface of each of the second plurality of cavities.

8. The ice making machine of claim 7, wherein the heat pipe contains a refrigerant.

9. The ice making machine of claim 7, wherein the heat block comprises a solid material with a thermal conductivity of at least 0.01 cal/s*cm*C.°.

10. The ice making machine of claim 7, wherein the heat block is insulated everywhere except for the first tray contact side and the second tray contact side.

11. The ice making machine of claim 7, wherein the heat exchanger comprises fins comprised of a solid material with a thermal conductivity of at least 0.01 cal/s*cm*C.°.

12. The ice making machine of claim 7, wherein the ice cube tray is configured such that portion of water that freezes last in each of the first plurality of cavities and in each of the second plurality of cavities forms a piece of ice containing undesirable impurities such that the piece can be broken off or melted from the clear, pure ice formed in each of the first plurality of cavities and each of the second plurality of cavities.

* * * * *